United States Patent [19]

Kroh et al.

[11] 4,125,046

[45] Nov. 14, 1978

[54] FOOD SLICER

[76] Inventors: Norma J. Kroh; George Spector, both of 3615 Woolworth Bldg., 233 Broadway, New York, N.Y. 10007

[21] Appl. No.: 733,847

[22] Filed: Oct. 19, 1976

[51] Int. Cl.[2] ..... B26D 4/50

[52] U.S. Cl. ..... 83/437; 83/467 R; 83/762; 269/288; 269/295

[58] Field of Search ..... 83/762, 437, 467, 468; 269/288, 291, 292, 295, 87.2

[56] References Cited

U.S. PATENT DOCUMENTS

| | | | |
|---|---|---|---|
| 1,005,128 | 10/1911 | Blain | 83/437 |
| 1,131,333 | 3/1915 | Coon | 83/762 |
| 1,703,154 | 2/1929 | Lanzkron | 83/762 |

FOREIGN PATENT DOCUMENTS

| | | | |
|---|---|---|---|
| 556,260 | 9/1943 | United Kingdom | 268/288 |

*Primary Examiner*—J. M. Meister

[57] ABSTRACT

A kitchen implement for evenly slicing meats, breads and other foods; the implement including a wooden base upon which a sheet metal frame is mounted, the frame having vertical opposite sides and a horizontal top with a series of parallel slits close together extending around the frame so a knife blade can be guided therein as it slices through a food placed upon the base; the food being firmly held from sliding between a pair of separate end plates during the slicing operation.

2 Claims, 2 Drawing Figures

FOOD SLICER

This invention relates generally to kitchen implements and tools.

It is well known that many homemakers prefer to buy luncheon meats in a large piece and then slice it herself because it is cheaper and tastes fresher if sliced just before being eaten. However, slicing a luncheon meat at home by a knife does not result in the even and thin slices that can be produced by a machine in the butcher shop so that this situation is in want of an improvement.

Therefore, it is a principal object of the present invention to provide a food slicer for use at home which produces even thickness food slices that equal the slicing quality of a machine in a butcher shop but which is hand operated with a knife at home so it eliminates need to invest in any costly machine.

Another object is to provide a food slicer that can be used for slicing fresh bread which otherwise will crumble or squeeze during ordinary knife slicing, or which can be used to slice vegetables such as eggplant or the like and frozen dough so to form cookies.

Another object is to provide a food slicer which can make slices of different thickness.

Other objects are to provide a Food Slicer which is simple in design, inexpensive to manufacture, rugged in construction, easy to use and efficient in operation.

Figure 1:
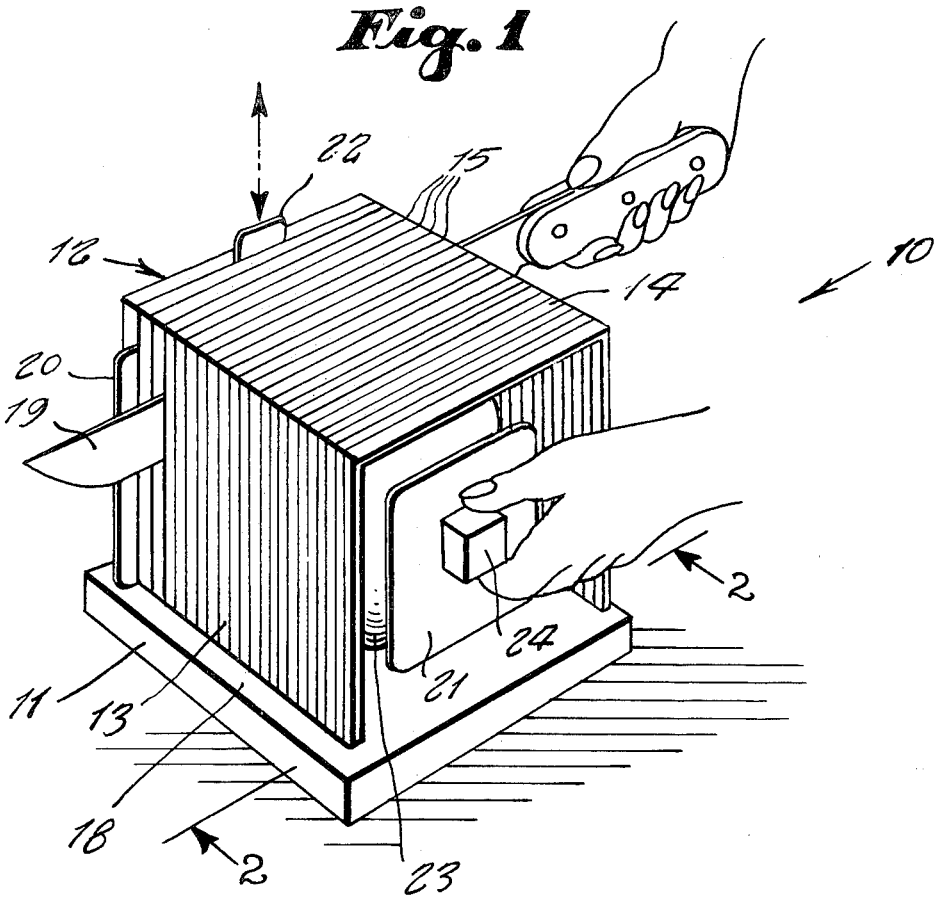

These and other objects will be readily evident upon a study of the following specifications and the accompanying drawing wherein:

FIG. 1 is a perspective view of the invention shown in operative use.

Figure 2:
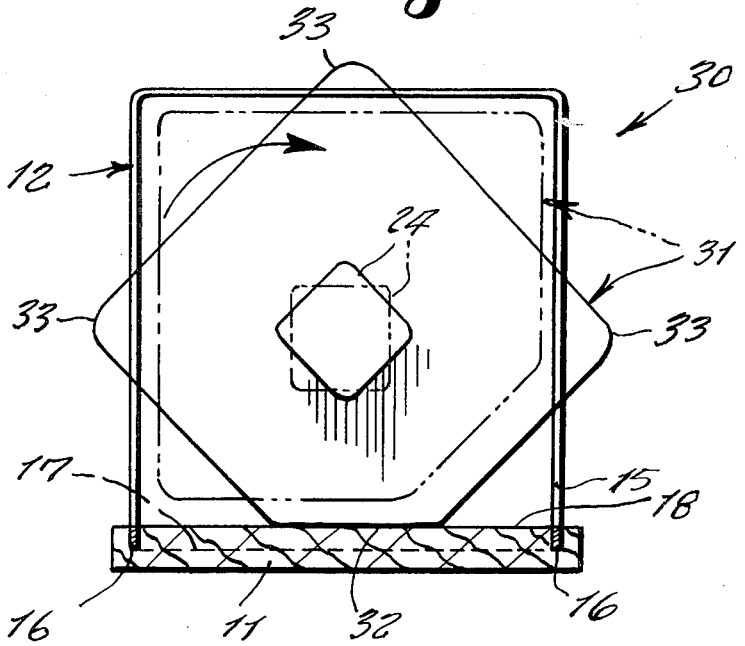

FIG. 2 is an end view thereof, and showing a modified design of the invention in which the pusher, which is held in the hand, is now replaced by a pusher which is inserted inside the tunnel of the slicer and is then rotated 45 degrees so that the corners of the pusher get locked in one of the slicer slits, thus securing the pusher and allowing a person's left hand free so to hold the slicer from sliding while slicing food.

Referring now to the drawing in detail, and more particularly to FIG. 1 at this time, the reference numeral 10 represents a food slicer according to the present invention wherein there is a wooden base 11 upon which there is secured a frame 12 made of rigid sheet metal bent into an inverted U-shape and which includes opposite, vertical side walls 13 nd a horizontal top wall 14. A series of parallel slots 15 extend around the three sides of the frme. A lower edge 16 of each side wall is imbedded in a groove 17 formed on the upper side of the base, and the slots 15 do not extend to the edges 16 but terminate at a point that is level the upper surface 18 of the base as shown in FIG. 2 so that the frame remains in one piece. Each slot is of a width so to permit a knife blade 19 to be slidably received therein, as indicated in FIG. 1.

The present invention also includes a separate end plate 20 and a pusher plate 21. The end plate 20 comprises a flat metal plate sufficiently thin so to slide into an endmost slot 15, the plate having an extending tongue 22 so to be readily grasped in order to remove therefrom for purposes of being cleaned. The end plate 20 serves as a stop against which an item of food 23 is rested while being sliced.

The pusher plate 21 comprises a flat plate made of any suitable hard material that is easy to clean and which includes a knob 24 on one side; the plate 21 being of a size so that it can be inserted inside the frame and pushed against the food, as shown in FIG. 1, so to hold the food firmly between the pusher plate and the end plate during the slicing operation.

Accordingly, in operative use, one hand serves to hold the food item steady while the other hand moves the knife blade through the slot, as shown.

In FIG. 2, a modified design of food slicer 30 is the same as above described food slicer 10 in all respects except that in this design, a pusher plate 31 is used instead of pusher plate 21; the pusher plate 31 being a same as pusher plate 21 except that one of its corners is cut off so to have a diagonal edge 32 for resting upon base surface 18, when the pusher plate is rotated 45 degrees after being inserted under the frame as shown in FIG. 2 and is aligned so that corners 33 of the plate 31 lock in one of the slots 15. Thus in this position the article of food can be forcibly held between the end plate 20 and the pusher plate 31, thus freeing a person's hand from holding the pusher plate, and this hand can be used to steady the entire device from sliding upon a kitchen counter during a slicing operation.

Thus a modified design is provided. Thus plate 31 also functions as a retainer when rotated.

While various changes may be made in the detail construction, it is understood that such changes will be within the spirit and scope of the present invention, as is defined by the appended claims.

What is claimed is:

1. A food slicer, comprising in combination, a base and a hollow frame mounted upon said base, said frame being shaped to fit around the periphery of an article of food placed upon a top surface of said base, including a series of parallel transverse slots through said frame for receiving a knife blade in combination with a separate end abuttment plate slidably fitting in said slots and a separate pusher plate having a hand knob, said article of food being held between said end abuttment plate and said pusher plate during a slicing operation, wherein said pusher plate comprises a flat plate member of shape and dimension to fit within said frame and base, said pusher plate being rotatable about an axis perpendicular to said pusher plate to a second position wherein portions of said pusher plate project through said slot outwardly beyond said frame to function also as a retaining plate to retain said food against said abuttment plate.

2. A slicer as in claim 1 wherein the pusher plate and frame are of generally rectangular shape with one corner of said pusher plate being cut-off to form a flat edge adopted to engage and be supported by said base when in said second position.

* * * * *